US006547708B2

(12) United States Patent
Kawamura et al.

(10) Patent No.: US 6,547,708 B2
(45) Date of Patent: Apr. 15, 2003

(54) TENSION FLUCTUATION ABSORBING DEVICE AND CARDBOARD SHEET MANUFACTURING APPARATUS EQUIPPED WITH THE SAME

(75) Inventors: Masanori Kawamura, Nishikikasugai-gun (JP); Masanori Kunimoto, Kani (JP)

(73) Assignee: Kabushiki Kaisha Isowa-Hooperswift, Aichi (JP)

( * ) Notice: Subject to any disclaimer, the term of this patent is extended or adjusted under 35 U.S.C. 154(b) by 95 days.

(21) Appl. No.: 09/810,358

(22) Filed: Mar. 16, 2001

(65) Prior Publication Data

US 2002/0037794 A1 Mar. 28, 2002

(30) Foreign Application Priority Data

Sep. 22, 2000 (JP) ..... 2000-289044

(51) Int. Cl.[7] ..... B31B 1/70; B31B 1/72; B31B 15/00; B31B 7/00

(52) U.S. Cl. ..... 493/84; 493/93; 242/410; 242/412

(58) Field of Search ..... 493/84, 93, 96, 493/81; 156/157, 502; 242/555, 410, 412

(56) References Cited

U.S. PATENT DOCUMENTS 5,114,509 A * 5/1992 Johnston et al.
5,325,306 A * 6/1994 Adachi et al.
5,437,749 A * 8/1995 Pipkorn et al.
RE36,687 E * 5/2000 Marschke et al.

* cited by examiner

*Primary Examiner*—Eugene Kim
(74) *Attorney, Agent, or Firm*—Koda & Androlia

(57) ABSTRACT

A tension fluctuation absorbing device used in a cardboard sheet manufacturing apparatus and equipped with a tension fluctuation detection assembly and a tension adjustment assembly. The tension fluctuation detection assembly detects fluctuations in the tension generated in a material paper. The tension adjustment assembly is installed on the upstream side of the tension fluctuation detection assembly and adjusts the tension generated in the material paper by increasing or decreasing the feed-out speed of the material paper on the basis of fluctuations in tension detected by the tension fluctuation detection assembly.

4 Claims, 7 Drawing Sheets

TENSION FLUCTUATION ABSORBING DEVICE AND CARDBOARD SHEET MANUFACTURING APPARATUS EQUIPPED WITH THE SAME

BACKGROUND OF THE INVENTION

1. Field of the Invention

The present invention relates to a tension fluctuation absorbing device and a cardboard sheet manufacturing apparatus equipped with this device and more particularly to the present invention relates to a tension fluctuation absorbing device and a cardboard sheet manufacturing apparatus equipped with this device which make it possible to manufacture a cardboard sheet with good quality by reliably absorbing fluctuations in the tension generated in the material paper.

2. Prior Art

A recently developed cardboard sheet manufacturing apparatus makes it possible to manufacture a cardboard sheet by accomplishing good bonding between the core and liner with hardly applying a nip pressure between the core and liner.

This cardboard sheet manufacturing apparatus will be described below with reference to a case in which a single-faced cardboard sheet is manufactured and a case in which a double-faced cardboard sheet is manufactured.

FIG. 7 is an overall schematic system diagram of a conventional single-faced cardboard sheet manufacturing apparatus.

As shown in FIG. 7, the single-faced cardboard sheet manufacturing apparatus 100 is comprised of: a roll stand 120 which is equipped with material paper rolls; a splicer 140 which performs paper splicing; and a single-facer 160 which manufactures a cardboard sheet by gluing together a core material paper B and a liner material paper A which are respectively fed out from the roll stand 120 and spliced in some cases. These components are arranged in the described order from the upstream side toward the downstream side of the line through which the material paper is fed. In the following description, the "line" refers to a path along which the material paper is fed.

The roll stand 120 has a liner driven roll 180 around which the liner material paper A is wound, and a core driven roll 200 around which the core material paper B is wound. These respective driven rolls 180 and 200 are equipped with reserve rolls (only 180*b* is shown) used for paper splicing, and the apparatus is arranged. When the material paper of the roll currently being used is exhausted, this paper is spliced to the corresponding reserve roll by the splicer 140, which will be described later.

The splicer 140 is a paper-splicing device and has: a pressing contact mechanism 260 which performs paper splicing by pressing the material paper on the material paper roll currently in operation against the material paper on the material paper roll held in reserve; an accumulator roll unit 320 which is disposed on the downstream side of the line from this pressing contact mechanism 260 and which consists of a plurality of accumulator rolls 280 and a plurality of supporting rolls 300; and a roll moving means which moves the plurality of accumulating rolls 280 between an ordinary operating position and a paper-splicing position. A plurality of strips of accumulated material paper are formed by these rolls. As a result of this structure, the material paper in use is accumulated by winding the material paper onto the accumulator rolls 280 in a number of stages, and the accumulator rolls 280 are moved from the ordinary operating position to the paper-splicing position immediately prior to the splicing of the paper, thus ensuring that a surplus amount of material paper is maintained with respect to the amount of material paper that is fed out by the line, so that the old material paper and new material paper are spliced by a two-sided tape glued to the new material paper beforehand while the paper in use is maintained in a state which is the same as the paper being stopped, after which the accumulator rolls 280 are returned to the ordinary operating position.

The single-facer 160 has a first stepped driving roll 360. It also has a second stepped driving roll 380 which is disposed so that the core material paper B is passed between this second stepped driving roll 380 and the first stepped driving roll 360 and formed into a corrugated shape as a result of the rotation of the aforementioned first stepped driving roll 360. Furthermore, a first guide roll 400 is installed on the first stepped driving roll 360 on the advancing side in the direction of rotation of the first stepped driving roll 360 with respect to the second stepped driving roll 380. The first guide roll 400 is used in cooperation with the first stepped driving roll 360 to guide the liner material paper A in a configuration in which the liner material paper A is superimposed on the core material paper B. Also, a second guide roll 440 is installed on the advancing side in the direction of rotation of the first stepped driving roll 360 with respect to the aforementioned first guide roll 400. The second guide roll 440 is used in cooperation with the first stepped driving roll 360 to guide the glued liner material paper A and core B. Furthermore, a glue application roll 420, which is used to apply glue to the core that has been formed into a corrugated shape, is installed on the first stepped driving roll 360 between the first guide roll 400 and the second stepped driving roll 380.

The liner material paper A supplied to the single-facer 160 is fed in contact with the circumferential surface of the drum of a pre-heater 150. The liner material paper A is thus preheated. The single-faced cardboard sheet D manufactured by the single-facer 160 is supplied by take-up conveyors 700 to a transfer conveyor 710 and further to a double-facer (not shown)

With the above structure, the fed-out core material paper is formed into a corrugated core by being passed between the first stepped driving roll 360 and second stepped driving roll 380 under a specified nip pressure; then, while glue is applied by the glue application roll 420. The fed-out liner A is, along with the glue-coated core B, fed along the outer circumferential surface of the first stepped driving roll 360 and passes between the first stepped driving roll 360 and the first guide roll 400 and then between the first stepped driving roll 360 and the second guide roll 440.

In this case, the rotational speed of the second guide roll 440 is set at a greater speed than the rotational speed of the first stepped driving roll 360. As a result, a specified tension is applied to the liner material paper A between the first guide roll 400 and the second guide roll 440, thus causing the liner material paper A to be pressed against the outer surface of the first stepped driving roll 360 while clamping the core B. While the liner material paper A and core B are guided in this state, the bonding of the liner material paper A and core B is completed, so that the production of a single-faced cardboard sheet is completed.

As seen from the above, good bonding of the core and liner A is accomplished by applying tension to the liner A between the first guide roll 400 and second guide roll 440 instead of applying a large nip pressure to the liner A and core between the first stepped driving roll 360 and first guide roll 400. In other words, by performing the gluing of the core and liner in a surface contact configuration instead of the conventionally used linear contact configuration, it is possible to prevent the formation of pressure scars on the outer surface of the liner, and to prevent deleterious effects on subsequent processes such as the bar code printing process, etc.

Next, a double-faced cardboard sheet manufacturing apparatus will be described. In order to manufacture a double-faced cardboard sheet by gluing a back liner to a single-faced cardboard sheet manufactured by a single-facer, the double-faced cardboard sheet manufacturing apparatus has the single-faced cardboard sheet manufacturing apparatus, a back liner supply device which supplies a back liner, and a double-facer which is used to manufacture the double-faced cardboard sheet. The back liner supply device has a back liner roll stand and a splicer. Meanwhile, the double-facer has a pre-heater which is used to heat the formed single-faced cardboard sheet and the supplied back liner, a glue machine which is used to apply glue to the pre-heated single-faced cardboard sheet and back liner, and a heated unit which is used to bond the single-faced cardboard sheet and back liner to which glue has been applied.

As a result of such a structure, a double-faced cardboard sheet which is favorably glued with no residual pressure scars is manufactured in the same manner as a single-faced cardboard sheet by gluing together a single-faced cardboard sheet and the back liner.

However, in the case of such single-faced and double-faced cardboard sheet manufacturing apparatuses, the gluing together of the core and liner is greatly affected by the tension that is generated in the core and liner. Thus, the technical problems described below arise because of the operating modes used during paper splicing and ordinary operation.

First of all, during paper splicing, the tension generated in the liner especially tends to fluctuate.

More specifically, during paper splicing, as described above, the dancer roll moves from the ordinary operating position to the paper-splicing position while paper splicing is being performed by pressing the old material paper and new material paper together. Thus, there is no feed-out of the old material paper. It creates a state in which there is almost no tension acting on the old material paper. However, since the movement of the dancer roll is performed along with the initiation of ordinary pressing contact, an impact load is generated in the material paper accompanying such pressing contact; as a result, a substantially pulse-form fluctuation in tension is generated in the material paper.

Secondly, during ordinary operation, as shown in FIG. 7, the completed single-faced cardboard sheet is caused to reside for a time in one location in order to ensure a specified drying time for the purpose of drying the bonded portions of the core and liner. This is done in order to process the single-faced cardboard sheet in subsequent processes such as a double-facer or printing process, etc. In this case, if the processing speed of the subsequent process increases, the residing portion of the cardboard sheet is reduced so that the drying time cannot be guaranteed; accordingly, it becomes necessary to increase the processing speed in the single-facer 160 accordingly. As a result, the pulling speed of the material paper is increased, so that the tension generated in the material paper increases. Conversely, if the processing speed of the subsequent process is reduced, the resident portion [of the material paper] becomes excessive, so that the pulling speed of the material paper is slowed, thus causing a drop in the tension generated in the material paper. Thus, from the standpoint of efficient product processing, a situation is created in which the tension must be caused to fluctuate by artificial means.

Thus, both during ordinary operation and during paper splicing, the tension generated in the liner or core fluctuates; because of this fluctuation, various problems occur in the cardboard sheet product, as will be described below.

Examples of problems that are common to both single-faced cardboard sheets and double-faced cardboard sheets include, first of all, the occurrence of warping in the completed cardboard sheet. This warping can be broadly classified as S-warping, downward-warping and upward-warping; these types of warping occur in the direction of flow and/or the direction of width, and have a deleterious effect on the printing process and box-making process, as well as lowering the strength of the completed boxes.

Secondly, small marks are printed at a specified pitch on the ends of cardboard sheets in order to cut the manufactured cardboard sheets or in order to measure the amount of production, and these marks are used as various types of production control data by reading the marks using a sensor. However, fluctuations in tension cause the pitch of the marks to vary, so that there are errors in the cutting length and deleterious effects on various types of production control data.

Examples of problems that are peculiar to single-faced cardboard sheets include, first of all, the fact that the bonding positions of the core and liner shift so that good bonding cannot be achieved if the tension generated in the core or liner fluctuates during the period prior to the completion of bonding by the drying of the glue.

Secondly, a problem that is peculiar to the core is that splitting and collapse of the corrugations may occur if an excessive tension is abruptly applied to the core.

Thus, fluctuations in tension according to the operating mode may cause various problems in the cardboard sheet product. However, a tension fluctuation absorbing device which is used to handle such fluctuations in tension is disclosed in, for example, Japanese Patent Application Laid-Open (Kokai) No. H10-45290.

The tension fluctuation absorbing device is installed on the downstream side of the line from the splicer and has a tension fluctuation detection means and a tension adjustment means. The tension fluctuation detection means is equipped with: a dancer roll on which a material paper is wound; a pinion/rack mechanism which supports the abovementioned dancer roll so that the dancer roll can roll in a direction that is substantially perpendicular to the axial line of the dancer roll and which consists of pinions that are installed on the respective ends of the dancer roll and racks that engage with these pinions; and a piston/cylinder mechanism which drives this dancer roll so as to balance the tension that acts on the dancer roll via the material paper on the upstream side of the line and material paper on the downstream side of the line that is wound on the dancer roll. The tension fluctuation detection means is used to detect fluctuations in the tension generated in the material paper. The tension adjustment means is equipped with: a driving roll which feeds out the material paper, a rotational speed adjustment means which is used to adjust the rotational speed of the aforementioned driving roll, and pressing rolls which are installed adjacent to the aforementioned driving roll. The tension adjustment means is used to adjust the tension generated in the material paper by increasing or decreasing the feed-out speed of the material paper on the basis of fluctuations in tension detected by the tension fluctuation detection means while applying a specified nip pressure to the material paper that passes between the driving roll and the pressing rolls. The tension adjustment means is installed in the vicinity of the tension fluctuation detection means on the upstream side of the line from the tension fluctuation detection means.

As a result of this structure, fluctuations in the tension generated in the material paper are detected by the tension fluctuation detection means, and the tension generated in the material paper is adjusted by adjusting the feed-out speed of the material paper on the basis of these detected fluctuations in the tension, so that such fluctuations in the tension can be limited.

However, the above conventional tension fluctuation absorbing device suffers from the following technical problems:

First, in this tension fluctuation absorbing device, the tension from the material paper acting on the dancer roll and the driving force from the piston/cylinder mechanism are balanced; and if there is a fluctuation in the tension, this balanced state is destroyed so that the dancer roll moves. Utilizing this fact, fluctuations in the tension are detected by detecting the movement of the dancer roll, and the detection sensitivity with respect to fluctuations in the tension in this case depends mainly on the response of the movement of the dancer roll to such fluctuations in the tension. In this respect, if the directions of extension of the material paper on the upstream side of the line and downstream side of the line are not parallel to the direction of extension of the racks, only the component of the fluctuation in the tension that is oriented in the direction of extension of the racks has an effect on the balance. Accordingly, the response is unavoidably inferior. In particular, the abovementioned problems regarding the cardboard product in a single-facer and double-facer also arise as a result of minute fluctuations in tension. Specifically, the bonding between the core and liner in a single-facer is not based on a permeating bond that is superior in terms of joining strength, but instead depends mainly on interfacial adhesion. Accordingly, if a slight shift occurs between the core and liner that accompanies minute fluctuations in the tension, this may lead to faulty bonding.

Secondly, the total length of the line extending from the roll stand to the single-facer or double-facer via the splicer may reach a considerable length. Accordingly, there may be external factors that disturb the tension such as acceleration or deceleration or mechanical losses such as friction, etc., of intermediate rolls installed at intermediate points on the line. Thus, if the position where fluctuations in the tension are actually a problem and the position where the tension is detected or the position where the tension is adjusted are separated from each other, reliable tension detection and adjustment are either impossible or extremely difficult. In this regard, it is very desirable that the tension be detected and adjusted in the vicinity of the single-facer and double-facer on the upstream side of the single-facer and double-facer, where fluctuations in tension are actually a problem.

Meanwhile, in cases where existing cardboard manufacturing apparatuses must be extensively modified (or in some cases replaced) in order to prevent such fluctuations in tension, expensive initial costs and long-term shutdowns of the manufacturing lines are unavoidable. In this regard, the development of a tension fluctuation absorbing device that can be incorporated into existing cardboard manufacturing apparatuses as a self-contained unit is strongly desired.

BRIEF SUMMARY OF THE INVENTION

Accordingly, in light of the above problems, one object of the present invention is to provide a cardboard sheet manufacturing apparatus which allows the quick and reliable handling of fluctuations in the tension generated in the material paper.

Another object of the present invention is to provide a cardboard sheet manufacturing apparatus, which makes it possible to manufacture good-quality cardboard by reliably performing good bonding between the core and liner.

Another object of the present invention is to provide a tension fluctuation absorbing device which can prevent fluctuations in the tension generated in the material paper, and which can be incorporated into existing cardboard sheet manufacturing apparatuses as a self-contained unit without any need for extensive modifications or alterations.

The above object of the present invention is accomplished by a unique structure for a tension fluctuation absorbing device that comprises:

a tension fluctuation detection means equipped with:
- a dancer roll on which a material paper is wound,
- a pinion/rack mechanism which supports the dancer roll so that the dancer roll can roll in a direction that is substantially perpendicular to an axial line of the dancer roll, the pinion/rack mechanism comprising pinions that are installed on respective ends of the dancer roll and racks that engage with the pinions, and
- a piston/cylinder mechanism which drives the dancer roll so as to balance a tension that acts on the dancer roll via the material paper on an upstream side of the dancer roll and the material paper on a downstream side of the dancer roll,
- so that the tension fluctuation detection means detects fluctuations in tension generated in the material paper via a movement of the dancer roll from a balance reference position thereof, and a tension adjustment means that is installed in the vicinity of the tension fluctuation detection means on an upstream side of the tension fluctuation detection means and is equipped with:
- a driving roll which feeds out the material paper,
- a rotational speed adjustment means which is used to adjust a rotational speed of the driving roll, and
- pressing rolls which are installed adjacent to the driving roll,
- so that the tension adjustment means adjusts a tension generated in the material paper by increasing or decreasing a feed-out speed of the material paper based upon fluctuations in tension detected by the tension fluctuation detection means, while applying a specified nip pressure to the material paper that passes between the driving roll and the pressing rolls, in which the tension fluctuation detection means is further equipped with guide rolls which are respectively installed on the upstream side and on the downstream side of the dancer roll so that a direction of extension of the material paper on the upstream side of the dancer roll and a direction of extension of the material paper on the downstream side of the dancer roll are substantially parallel to a direction in which the racks extend, a driving force of the piston/cylinder mechanism is adjustable based upon a tension that acts on the dancer roll via the material paper on the upstream side and on the downstream side, and the pressing rolls comprise a plurality of rolls which have axial lengths that are shorter than axial length of the driving roll and which are arranged substantially in a straight line along the axial length of the driving roll.

The above object of the present invention is accomplished by a unique structure for a single-faced cardboard sheet manufacturing apparatus that is equipped with a single-facer that manufactures a single-faced cardboard sheet by gluing together a liner material paper and a core material paper in a specified corrugated form, while feeding out the liner material paper and core material paper, the single-faced cardboard sheet manufacturing apparatus further comprising a tension fluctuation detection means and a tension adjustment means, in which the tension fluctuation detection means is provided in the vicinity of the single-facer on an upstream side of the single-facer and is used to detect fluctuations in tension generated in the liner material paper and/or core material paper, the tension fluctuation detection means comprising:

a dancer roll on which the liner material paper and/or core material paper are wound, a pinion/rack mechanism which supports the dancer roll so that the dancer roll can roll in a direction that is substantially perpendicular to an axial line of the dancer roll, the pinion/rack mechanism comprising pinions that are installed on respective ends of the dancer roll and racks that engage with the pinions, a piston/cylinder mechanism which drives the dancer roll so as to balance a tension that acts on the dancer roll via the liner material paper and/or core material paper on an upstream side of the dancer roll and via the liner material paper and/or core material paper on a downstream side of the dancer roll, and guide rolls which are respectively installed on the upstream side and on the downstream side of the dancer roll so that a direction of extension of the liner material paper and/or core material paper on the upstream side of the dancer roll and a direction of extension of the liner material paper and/or core material paper on the downstream side of the dancer roll are both substantially parallel to a direction of extension of the racks; and the tension adjustment means is provided in the vicinity of the tension fluctuation detection means on an upstream side of the tension fluctuation detection means and is used to adjust the tension generated in the liner material paper and/or core material paper in the vicinity of the single-facer by increasing or reducing a feed-out speed of the liner material paper and/or core material paper to the single-facer based upon fluctuations in tension detected by the tension fluctuation detection means, the tension adjustment means comprising:

a driving roll which feeds out the liner material paper and/or core material paper, a rotational speed adjustment means which is used to adjust a rotational speed of the driving roll, and pressing rolls which are installed adjacent to the driving roll, so that the tension adjustment means applies a specified nip pressure to the liner material paper and/or core material paper that pass between the driving roll and the pressing rolls.

The above object of the present invention is further accomplished by a unique structure for a single-faced cardboard sheet manufacturing apparatus that comprises:

a liner driven roll on which a liner material paper is wound, a core driven roll on which a core material paper is wound, a single-facer which manufactures a single-faced cardboard sheet by gluing together, through application of tension to the liner material paper, the liner material paper and a core that has been produced by forming the core material paper into a specified corrugated form, while feeding out the liner material paper from the liner driven roll and feeding out the core material paper from the core driven roll, and a tension detection means which is provided between the liner driven roll and/or the core driven roll and the single-facer and is used to detect a tension generated in the liner material paper and/or core material paper, and a tension rough adjustment means provided in the liner driven roll and/or core driven roll, the tension rough adjustment means making a rough adjustment of the tension generated in the liner material paper and/or core material paper by decreasing a rotational speed of the liner driven roll and/or core driven roll based upon a tension detected by the tension detection means;

the single-faced cardboard sheet manufacturing apparatus further comprising a tension fluctuation detection means and a tension adjustment means, in which the tension fluctuation detection means is provided in the vicinity of the single-facer on an upstream side of the single-facer and is used to detect fluctuations in tension generated in the liner material paper and/or core material paper, the tension fluctuation detection means comprising:

a dancer roll on which the liner material paper and/or core material paper are wound, a pinion/rack mechanism which supports the dancer roll so that the dancer roll can roll in a direction that is substantially perpendicular to an axial line of the dancer roll, the pinion/rack mechanism comprising pinions that are installed or. respective ends of the dancer roll and racks that engage with the pinions, a piston/cylinder mechanism which drives the dancer roll so as to balance a tension that acts on the dancer roll via the liner material paper and/or core material paper on an upstream side of the dancer roll and via the liner material paper and/or core material paper on a downstream side of the dancer roll, and guide rolls which are respectively installed on the upstream side and on the downstream side of the dancer roll so that a direction of extension of the liner material paper and/or core material paper on the upstream side of the dancer roll and a direction of extension of the liner material paper and/or core material paper on the downstream side of the dancer roll are both substantially parallel to a direction of extension of the racks; and the tension adjustment means is provided in the vicinity of the tension fluctuation detection means on an upstream side of the tension fluctuation detection means and is used to adjust the tension generated in the liner material paper and/or core material paper in the vicinity of the single-facer by increasing or reducing a feed-out speed of the liner material paper and/or core material paper to the single-facer based upon fluctuations in tension detected by the tension fluctuation detection means, the tension adjustment means comprising:

a driving roll which feeds out the liner material paper and/or core material paper, a rotational speed adjustment means which is used to adjust a rotational speed of the driving roll, and pressing rolls which are installed adjacent to the driving roll, so that the tension adjustment means applies a specified nip pressure to the liner material paper and/or core material paper that pass between the driving roll and the pressing rolls.

The above single-faced cardboard sheet manufacturing apparatus preferably further includes a paper splicing device provided on the upstream side of the tension adjustment means, the paper splicing device comprising:

a pressing contact mechanism which effects paper splicing by causing pressing contact between the material paper on a material paper roll that is in operation and the material paper on a material paper roll that is in reserve, an accumulator roll unit which is disposed on a downstream side of the pressing contact mechanism and which is equipped with a plurality of accumulator rolls and a plurality of supporting rolls, and a roll moving means which causes the plurality of accumulator rolls to move between an ordinary operating position and a paper-splicing position, so that the paper splicing device forms a plurality of strips of accumulated material paper when the plurality of accumulator rolls are in the paper-splicing position.

Furthermore, it is preferable that in the above single-face cardboard sheet manufacturing apparatus, the single-facer comprises:

a first stepped driving roll which has wave-form step parts formed in an outer circumferential surface thereof, and a second stepped driving roll which has wave-form step parts formed in an outer circumferential surface thereof and engage with the wave-form step parts of the first stepped driving roll, the second stepped driving roll being disposed so that the core material paper is formed into a corrugated shape as a result of being caused to pass between the second stepped driving roll and the first stepped driving roll by rotation of the first stepped driving roll a first guide roll provided on the first stepped driving roll so as to be on an advancing side of a direction of rotation of the first stepped driving roll with respect to the second stepped driving roll, the first guide roll, in cooperation with the first stepped driving roll, guiding the liner material paper in a configuration in which the liner material paper is superimposed on the core material paper along an outer circumferential surface of the first stepped driving roll, and a second guide roll also provided on the first stepped driving roll so as to be on an advancing side of a direction of rotation of the first stepped driving roll with respect to the first guide roll, the second guide roll, in cooperation with the first stepped driving roll, guiding the liner material paper and the core material paper along the outer circumferential surface of the first stepped driving roll, in which rotational speed of the second guide roll is set at a greater value than rotational speed of the first stepped driving roll so that the liner material paper is pressed against the outer circumferential surface of the first stepped driving roll in a state in which the core material paper is clamped between the liner material paper and the outer circumferential surface of the first stepped driving roll as a result of application of a specified tension to the liner material paper between the first guide roll and the second guide roll.

The above object of the present invention is still further accomplished by a unique structure for a double-faced cardboard sheet manufacturing apparatus that is equipped with a double-facer that manufactures a double-faced cardboard sheet by gluing together a single-faced cardboard sheet and a back liner, the single-faced cardboard sheet comprising a liner and a core that is formed into a specified corrugated form, in which the double-faced cardboard sheet manufacturing apparatus comprises a tension fluctuation detection means and a tension adjustment means, and in which:

the tension fluctuation detection means provided in the vicinity of the double-facer and on an upstream side of the double-facer and used to detect fluctuations in tension generated in the back liner and, the tension fluctuation detection means comprising:

a dancer roll on which the back liner is wound, a pinion/rack mechanism which supports the dancer roll so that the dancer roll can roll in a direction that is substantially perpendicular to an axial line of the dancer roll, the pinion/rack mechanism comprising pinions that are installed on respective ends of the dancer roll and racks that engage with the pinions, a piston/cylinder mechanism which drives the dancer roll so as to balance a tension that acts on the dancer roll via the back liner on an upstream side of the dancer roll and via the back liner on a downstream side of the dancer roll, and guide rolls which are respectively installed on the upstream side and on the downstream side of the dancer roll so that a direction of extension of the back liner on the upstream side of the dancer roll and a direction of extension of the back liner on the downstream side of the dancer roll are both substantially parallel to the direction of extension of the racks; and the tension adjustment means is provided in the vicinity of the tension fluctuation detection means on an upstream side of the tension fluctuation detection means and is used to adjust the tension generated in the back liner in the vicinity of the double-facer by increasing or reducing a feed-out speed of the back liner to the double-facer based upon fluctuations in tension detected by the tension fluctuation detection means, the tension adjustment means comprising:

a driving roll which feeds out the back liner, a rotational speed adjustment means which is used to adjust a rotational speed of the driving roll, and pressing rolls which are installed adjacent to the driving roll, so that the tension adjustment means applies a specified nip pressure to the back liner that pass between the driving roll and the pressing rolls.

In the above double-faced cardboard sheet manufacturing apparatus, the single-faced cardboard sheet is preferably manufactured by the single-faced cardboard sheet manufacturing apparatus described above.

In the above tension fluctuation absorbing device of the present invention, which is constructed as described above, the generation of wrinkles in the material paper is prevented by splitting the pressing roll into plurality of rolls while constructing the device as a self-contained unit. At the same time, the device is disposed so that the direction of extension of the material paper on the upstream side of the line that is wound on the dancer roll and the direction of extension of the material paper on the downstream side of the line that is wound on the dancer roll are both substantially parallel to the direction of extension of the racks that support the dancer roll via pinions, thus insuring that the component of the fluctuation in tension that is oriented in the direction of extension of the racks when the tension generated in the material paper fluctuates is most prevalent; as a result, the response to movement of the dancer roll from the balance reference position can be improved, so that fine adjustments can be made with respect to fluctuations in tension. Furthermore, the tension value at the balance reference position of the dancer roll, i.e., the reference tension value that is used when fluctuations in the tension are detected, can be adjusted by adjusting the driving force of the piston/cylinder mechanism that balances the tension. Accordingly, not only fluctuations in the tension per se, but also, for example, excessive tension, can be detected, and this can be adjusted.

In the above single-faced cardboard sheet manufacturing apparatus of the present invention, which is constructed as described above, a tension fluctuation detection means is installed in the vicinity of the single-facer on the upstream side of the single-facer, where fluctuations in the tension generated in the core material paper or liner are a problem. Fluctuations in the tension generated in the core material paper or liner material paper are detected by this tension fluctuation detection means, and the tension generated in the material paper is adjusted by adjusting the feed-out speed of the core material paper or liner material paper toward the single-facer on the basis of these detected fluctuations in the tension. As a result, such fluctuations in the tension can be kept within a fixed range.

Accordingly, in cases where there are changes in the material paper processing speed of the single-facer in connection with after-processes such as a double-facer process or printing process, etc., during normal operation, or in cases where a pulse-form fluctuation in tension is generated in the material paper by the splicer during paper splicing, the fluctuations in tension occurring in the single-facer can be reliably detected, and such fluctuations in tension in the single-facer can be quickly and reliably prevented by finely adjusting the tension on the basis of the above-mentioned [detected] fluctuations in the tension. As a result, faulty adhesion between the core and liner, warping of the single-faced cardboard sheet and breaking or collapse of corrugations caused by such fluctuations in the tension can be prevented, so that a good-quality single-faced cardboard sheet can be manufactured.

In the above-described double-faced cardboard sheet manufacturing apparatus of the present invention, which is constructed as described above, a tension fluctuation detection means is installed in the vicinity of the double-facer on the upstream side of the double-facer, where fluctuations in the tension generated in the back liner are a problem. Fluctuations in the tension generated in the back liner are detected by this tension fluctuation detection means, and the tension generated in the back liner is adjusted by adjusting the feed-out speed of the back liner toward the double-facer on the basis of these detected fluctuations in the tension. As a result, such fluctuations in the tension can be kept within a fixed range. Accordingly, in cases where there are changes in the material paper processing speed of the double-facer in connection with after-processes such as a box-making process or printing process, etc., during normal operation, or in cases where a pulse-form fluctuation in tension is generated in the back liner by the splicer during paper splicing, the fluctuations in tension occurring in the double-facer can be reliably detected. Also, such fluctuations in tension in the double-facer can be quickly and reliably prevented by finely adjusting the tension on the basis of the detected fluctuations in the tension. As a result, warping of the double-faced cardboard sheet caused by such fluctuations in the tension can be prevented, and deleterious effects on production control such as a drop in productivity in after-processes (cutting process, etc.) can be avoided, so that a good-quality double-faced cardboard sheet can be manufactured.

DETAILED DESCRIPTION OF THE INVENTION

Embodiments of the present invention will be described in detail below.

The first embodiment of the present invention relates to an apparatus for manufacturing a single-faced cardboard sheet D.

Figure 1:
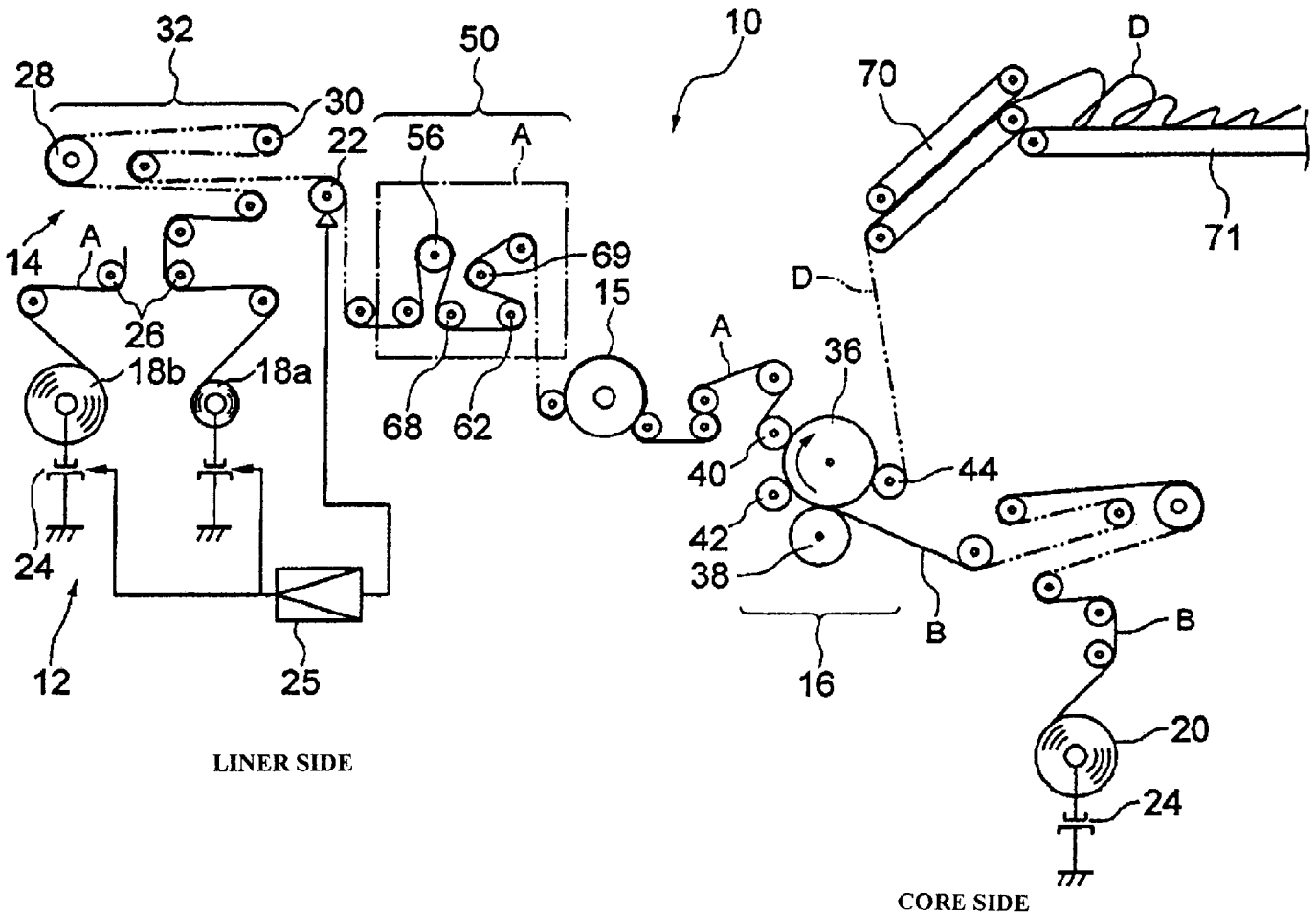
FIG. 1 is an overall schematic system diagram of a single-faced cardboard sheet manufacturing apparatus according to the first embodiment of the present invention.

As shown in FIG. 1, in order to manufacture a single-faced cardboard sheet D by gluing a core formed into a specified corrugated shape to a liner material paper A while this liner material paper A and a core material paper B are fed out, the apparatus 10 for manufacturing a single-faced cardboard sheet D is constructed from a roll stand 12 which is equipped with material paper rolls, a splicer 14 which performs splicing of the material paper, and a single-facer 16 which manufactures a cardboard sheet by gluing together the core material paper B and liner material paper A that are respectively fed out from the roll stand 12 (and that are spliced in some cases). In this respect, this apparatus 10 for manufacturing a single-faced cardboard sheet D is basically similar to a conventional apparatus for manufacturing a single-faced cardboard sheet D.

As shown in FIG. 1, the roll stand 12 has a liner driven roll 18 (18*a*, 18*b*) on which the liner material paper A is wound, a core driven roll 20 on which the core material paper B is wound, and a tension detection means 22 which is disposed between the liner driven roll 18 and single-facer 16, and which is used to detect tension generated in the liner material paper A. The liner driven roll 18 has a tension rough adjustment means 24 which is used to make a rough adjustment of the tension generated in the liner material paper A by adjusting the amount of deceleration in the rotational speed of the liner driven roll 18 on the basis of the tension detected by the tension detection means 22. More specifically, the tension detection means 22 is a conventional universally known tension detector, while the tension rough adjustment means 24 is a conventional universally known braking device, which is arranged so that the rotational speed of the liner driven roll 18 is reduced by the application of a brake to the winding shaft of the liner driven roll 18. The tension signal of the liner material paper A detected by the tension detector is transmitted to the tension rough adjustment means 24 via a tension amplifier 25, and the braking force is adjusted on the basis of this signal.

The splicer 14 has a pressing contact mechanism 26 which is used to perform paper splicing by pressing together the material paper of the material paper roll currently in use and the material paper of the material paper roll held in reserve, an accumulator roll unit 32 which is disposed on the downstream side of the line from the pressing contact mechanism 26, and which is equipped with a plurality of accumulator rolls 28 and a plurality of supporting rolls 30, and a roll moving means (not shown) which is used to move the plurality of accumulator rolls 28 between a normal operating position and a paper-splicing position. The splicer 14 is arranged so that a plurality of strips of accumulated material paper are formed when the plurality of accumulator rolls 28 are in the paper-splicing position.

The single-facer 16 has a first stepped driving roll 36 and a second stepped driving roll 38. The first stepped driving roll 36 has wave-form step parts formed on its outer circumferential surface. The second stepped driving roll 38 has wave-form step parts that engage with the wave-form step parts of the first stepped driving roll 36 formed on its outer circumferential surface. The second stepped driving roll 38 is arranged so that the core material paper B is formed into a corrugated shape as a result of being caused to pass between the second stepped driving roll 38 and first stepped driving roll 36 by the rotation of the first stepped driving roll 36. Furthermore, a first guide roll 40 is installed on the first stepped driving roll 36 so as to be on the advancing side in the direction of rotation of the first stepped driving roll 36 with respect to the second stepped driving roll 38. The first guide roll 40 is used in cooperation with the first stepped driving roll 36 to guide the liner material paper A in a configuration in which the liner material paper is superimposed on the core material paper B along the outer circumferential surface of the first stepped driving roll 36. A second guide roll 44 is further installed on the first stepped driving roll 36 so as to be on the advancing side in the direction of rotation of the first stepped driving roll 36 with respect to the first guide roll 40. The second guide roll 44 is used in cooperation with the first stepped driving roll 36 to guide the liner material paper A and core along the outer circumferential surface of the first stepped driving roll 36. Furthermore, a glue application roll 42 which is used to apply glue to the core that has been formed into a corrugated shape is installed between the first guide roll 40 and the second stepped driving roll 38. The rotational speed of the second guide roll 44 is set at a greater speed than the rotational speed of the first stepped driving roll 36. This is done so that a specified tension is applied to the liner material paper A between the first guide roll 40 and second guide roll 44, thus pressing the liner material paper A against the outer surface of the first stepped driving roll 36 a state in which the core is clamped between the liner material paper and the outer circumferential surface of the first stepped driving roll 36. With the structure above, a single-faced cardboard sheet D is manufactured by gluing the liner material paper A and core (produced by forming the core material paper B into a corrugated shape) together through the application of tension to the liner material paper A while the liner material paper A is fed out from the liner driven roll 18 and the core material paper B is fed out form the core driven roll 20.

Next, the tension fluctuation absorbing device 50 which is the characterizing part of the present invention will be described. The tension fluctuation absorbing device 50 is designed so as to be incorporated into the apparatus as a self-contained unit at a point that is located downstream from the splicer 14 and is located in the vicinity of the single-facer 16 on the upstream side of the line from the single-facer 16.

Figure 2:
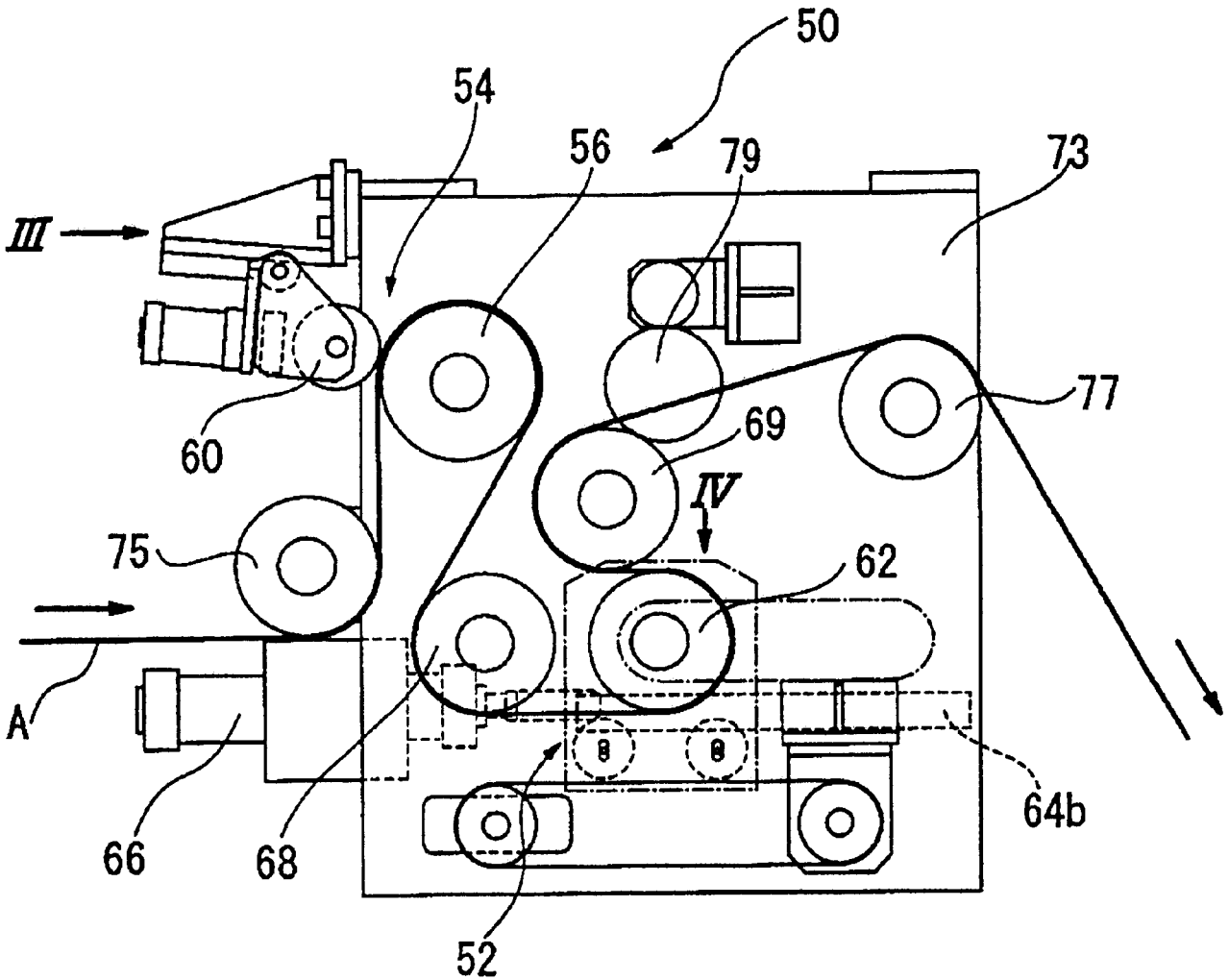
FIG. 2 is an enlarged view of part A in FIG. 1.

As shown in FIGS. 1 and 2, the tension fluctuation absorbing device 50 has a tension fluctuation detection means 52 and a tension adjustment means 54. The tension fluctuation detection means 52 is installed in the vicinity of the single-facer 16 on the upstream side of the line from the single-facer 16 (between frames 73 installed on both sides). The tension fluctuation detection means 52 is used to detect fluctuations in the tension generated in the liner material paper A in the vicinity of the single-facer 16. The tension adjustment means 54 is installed on the upstream side of the line from the tension fluctuation detection means 52. The tension adjustment means 54 is used to adjust the tension generated in the liner material paper A in the vicinity of the single-facer 16 by adjusting the feed-out speed of the liner material paper A to the single-facer 16 on the basis of the fluctuations in tension detected by the tension fluctuation detection means 52.

Figure 3:
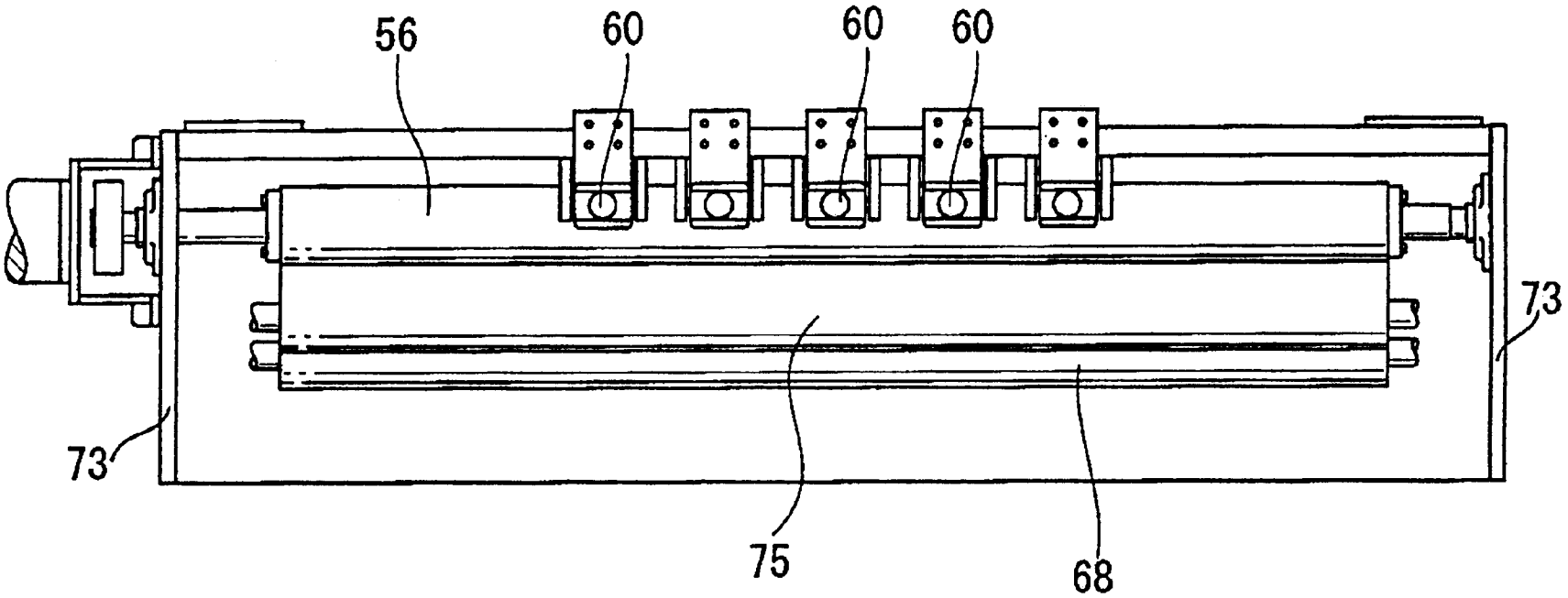
FIG. 3 is an enlarged partial side view as seen from the direction of arrow III in FIG. 2.

More specifically, as shown in FIG. 2, the tension adjustment means 54 has a driving roll 56 which feeds out the liner material paper A and a rotational speed adjustment means (not shown) which is used to adjust the rotational speed of this driving roll 56. The tension adjustment means 54 further has pressing rolls 60 that are installed adjacent to the driving roll 56, and a specified nip pressure is applied to the liner material paper A that passes between the driving roll 56 and the pressing rolls 60. As shown in FIG. 3, the pressing rolls 60 consist of five rolls that are lined up in substantially a straight line along the axial length of the driving roll 56. As a result, the generation of wrinkles in the liner material paper A can be prevented while a specified nip pressure that is sufficient to prevent slipping between the liner material paper A and the driving roll 56 is applied to the liner material paper A.

Figures 4A, 4B:
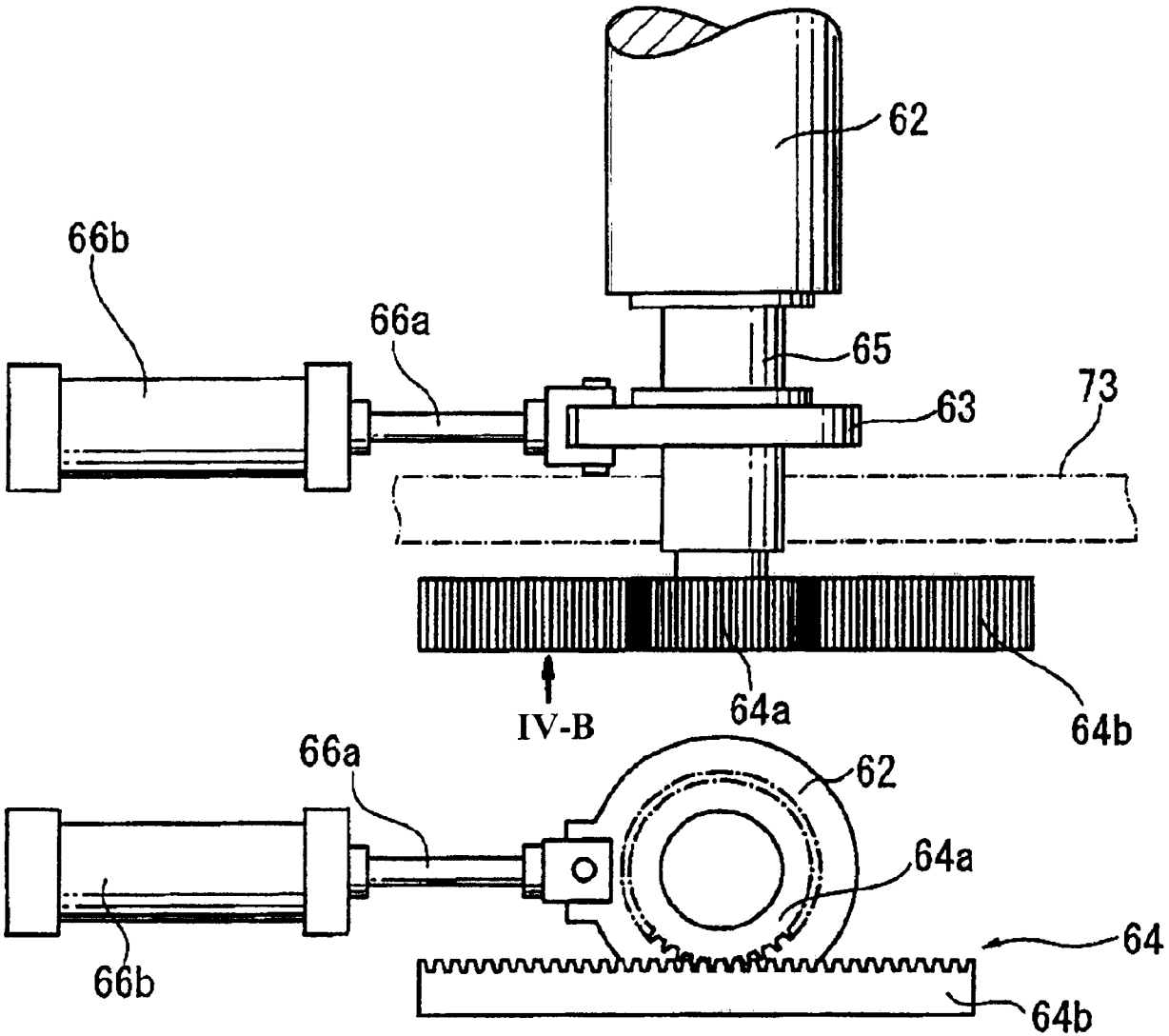
FIG. 4A is a partial plan view as seen from the direction of the arrow IV-A in FIG. 2.
FIG. 4B is a partial side view as seen from the direction of the arrow IV-B in FIG. 4A.

As seen from FIGS. 4A and 4B, the tension fluctuation detection means 52 has a dancer roll 62, a pinion/rack mechanism 64 and a piston/cylinder mechanism 66. On the dancer roll 62, the liner material paper A is wound. The end portion of the dancer roll 62 is supported by a bearing 63, and the bearing 63 is connected to the piston rod 66*a* of the piston/cylinder mechanism 66. The pinion/rack mechanism 64 supports this dancer roll 62 so that the dancer roll can roll in a direction that is substantially perpendicular to the axial line of the dancer roll. The pinion/rack mechanism 64 comprises pinions 64*a* that are installed on the respective ends of the dancer roll 62 and racks 64*b* that engage with these pinions 64*a*. The piston/cylinder mechanism 66 drives the dancer roll 62 so as to balance the tension acting on the dancer roll 62 via the material paper on the upstream side of the line from the dancer roll 62 and the material paper on the downstream side of the line from the dancer roll 62. Movement of the dancer roll 62 from the balance reference position is detected by an encoder (not shown), and the resulting detection signal is transmitted to the rotational speed adjustment means 58 of the driving roll 56. Furthermore, as shown in FIG. 2, guide rolls 68 and 69 are respectively installed on the upstream side of the line and the downstream side of the line from the dancer roll 62. The direction of extension of the material paper on the upstream side of the line from the dancer roll 62 and the direction of extension of the material paper on the downstream side of the line from the dancer roll 62 are set so as to be substantially parallel. As a result, the winding angle of the liner material paper A on the dancer roll 62 is approximately 180 degrees. Furthermore, the driving force of the piston/cylinder mechanism 66 can be adjusted on the basis of the tension that acts on the dancer roll 62 via the material paper on the upstream side of the line and the material paper on the downstream side of the line.

A pulse generator 79 that detects the substantial supply speed of the liner material paper A is further provided.

The operation of the single-faced cardboard sheet manufacturing apparatus 10 constructed as described above will be described below.

First, the liner material paper A is fed out from the respective driven rolls 18 (18*a,* 18*b*) by the driving roll 56 of the single-facer 16. In this case, the tension generated in the liner material paper A is detected, and this tension is roughly adjusted by adjusting the amount of deceleration in the rotational speed of the driving roll 56 on the basis of the resulting detection values by means of braking devices installed on the respective driven rolls. As a result, a base tension that is necessary in order to prevent the generation of wrinkles is respectively applied to the liner material paper A. Next, in the splicer 14, the liner material paper A is appropriately spliced, and in this case, fluctuations occur in the tension generated in the material paper. Next, the liner material paper A is pre-heated by the pre-heater 15.

Next, the liner material paper A reaches the tension fluctuation absorbing device 50 via the pre-heater 15 and guide roll 75. Here, fluctuations in the tension generated in the liner material paper A are detected by the tension fluctuation detection means 52 which is installed in the vicinity of the single-facer 16 on the upstream side of the line from the single-facer 16, and the tension generated in the liner material paper A in the vicinity of the single-facer 16 is adjusted by adjusting the feed-out speed of the liner material paper A on the basis of the detected fluctuations in the tension, so that the fluctuations in tension are kept within a fixed range.

Figure 5:
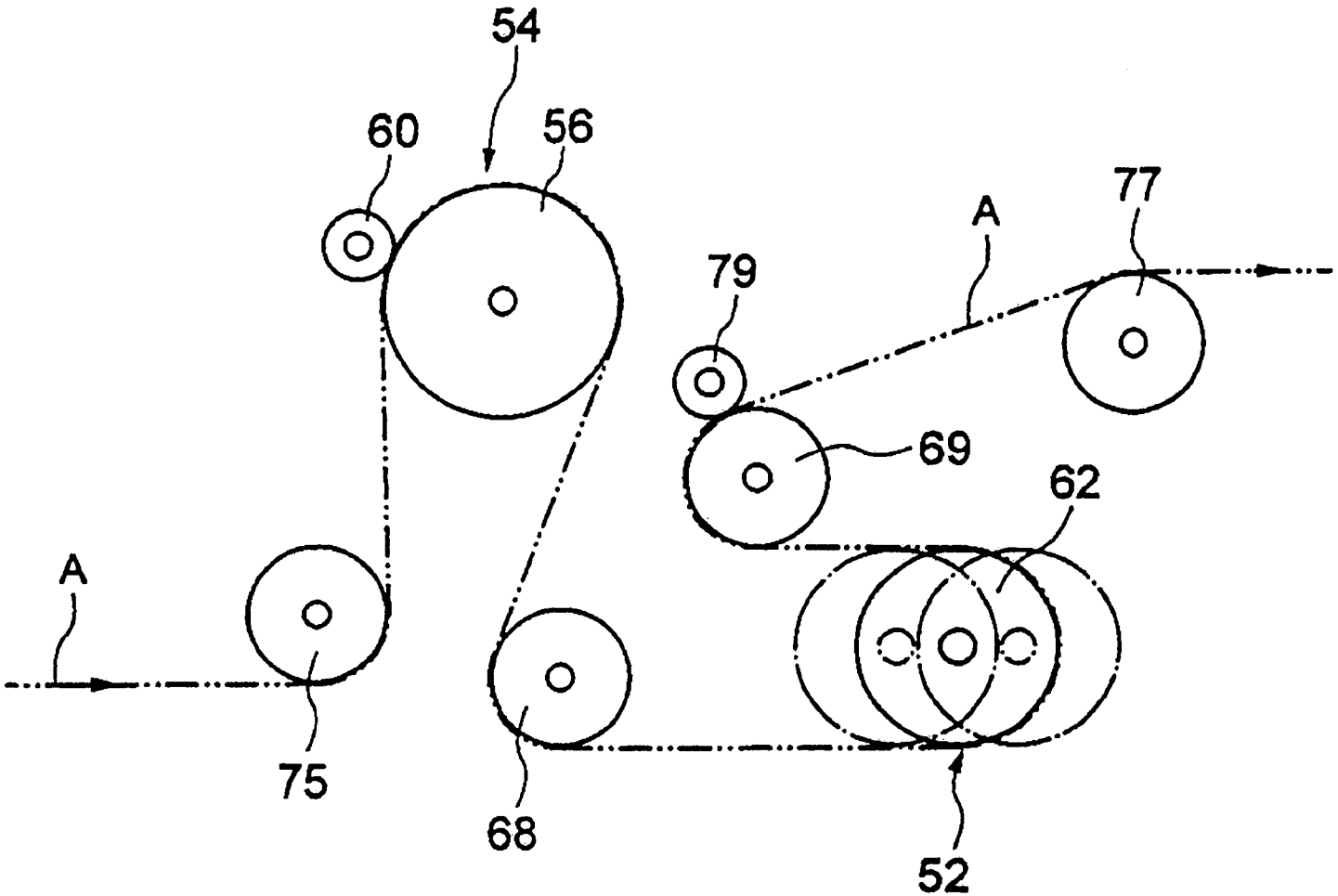
FIG. 5 is a schematic diagram illustrating the operation of the tension fluctuation absorbing device.

More concretely, if the tension generated in the material paper exceeds fixed limits during paper splicing or ordinary operation, the pinions 64*a* installed on both ends of the dancer roll 62 move while engaging the racks 64*b,* so that the dancer roll 62 moves from the reference balance position. For example, In cases where the tension exceeds the upper limit of a fixed range, the dancer roll 62 move to the upper lift side in FIG. 5. The movement is detected by an encoder (not shown), and a control signal is transmitted to the driving roll 56 from this encoder. The feed-out speed of the liner material paper A is adjusted by adjusting the rotational speed of the driving roll 56 on the basis of this control signal. When the liner material paper A passes between the driving roll 56 and the pressing rolls 60 installed in close proximity to the driving roll 56, the liner material paper A is pressed against the driving roll 56 by a specified nip pressure while the generation of wrinkles in the material paper is prevented by the five separate [pressing] rolls. Accordingly, the liner material paper A is fed by the driving roll 56 at a feed-out speed that corresponds to the rotational speed of the driving roll 56 without any slipping occurring between the liner material paper A and the driving roll 56. For example, when the rotational speed of the driving roll 56 is set at a speed that is greater than the feed-out speed determined by the first stepped driving roll 36 of the single-facer 16, the tension generated in the material paper on the downstream side of the driving roll 56 decreases as a result of the generation of slack in the material paper. On the other hand, when the rotational speed of the driving roll 56 is set at a speed that is smaller than the feed-out speed determined by the first stepped driving roll 36 of the single-facer 16, the tension generated in the material paper on the downstream side of the driving roll 56 increases as a result of the generation of additional tension in the material paper. By causing such deliberate increases or decreases in the tension by means of the driving roll 56, it is possible to make fine adjustments in order to absorb the fluctuations in the tension generated in the material paper on the upstream side of the driving roll 56; as a result, fluctuations in the tension of the material paper in the vicinity of the single-facer 16 can be kept within a specified range.

Furthermore, by adjusting the driving force of the dancer roll 62 by the piston/cylinder mechanism 66, or by appropriately selecting the installation positions of the guide rolls 68 and 69, the upstream-side and downstream-side directions of extension of the material paper wound on the dancer roll 62 can be appropriately adjusted. As a result, the value of the tension that is generated in the material paper at the balance reference position can be adjusted; and the reference tension value that serves as a reference for fluctuations in the tension can be appropriately adjusted.

Then, the liner material paper A in which fluctuations in tension have thus been appropriately prevented in the vicinity of the single-facer 16 on the upstream side of the single-facer 16 reaches the single-facer 16 via the guide roll 77. In the single-facer 16, the core material paper B is formed into a core with a specified corrugation. Furthermore, glue is applied to the peaks of the corrugations of the core material paper B by the glue application means. The liner material paper A is supplied to this point, and the glue-coated core and liner material paper A are bonded together. Thus, the core and liner material paper A are bonded by means of the tension applied to the liner material paper A, without any nip pressure being applied. Fluctuations in tension are prevented on the upstream side of the single-facer 16. Thus, there is no shifting between the liner material paper A and core. Accordingly, good bonding is possible, and the generation of warping in the single-faced cardboard sheet D can be prevented. Furthermore, since variations in the pitch of marks printed on the single-faced cardboard sheet D can be prevented, deleterious effects on production control or after-processes, e.g., cutting processes, can be avoided.

The completed single-faced cardboard sheet D is sent to a transporting conveyor 71 via a take-up conveyor 70. The, the sheet is supplied to after-processes such as printing or cutting processes, etc. and is placed in a waiting state.

By preventing fluctuations in the tension generated in the material paper as described above, it is possible to manufacture a good-quality single-faced cardboard sheet D.

Figure 6:
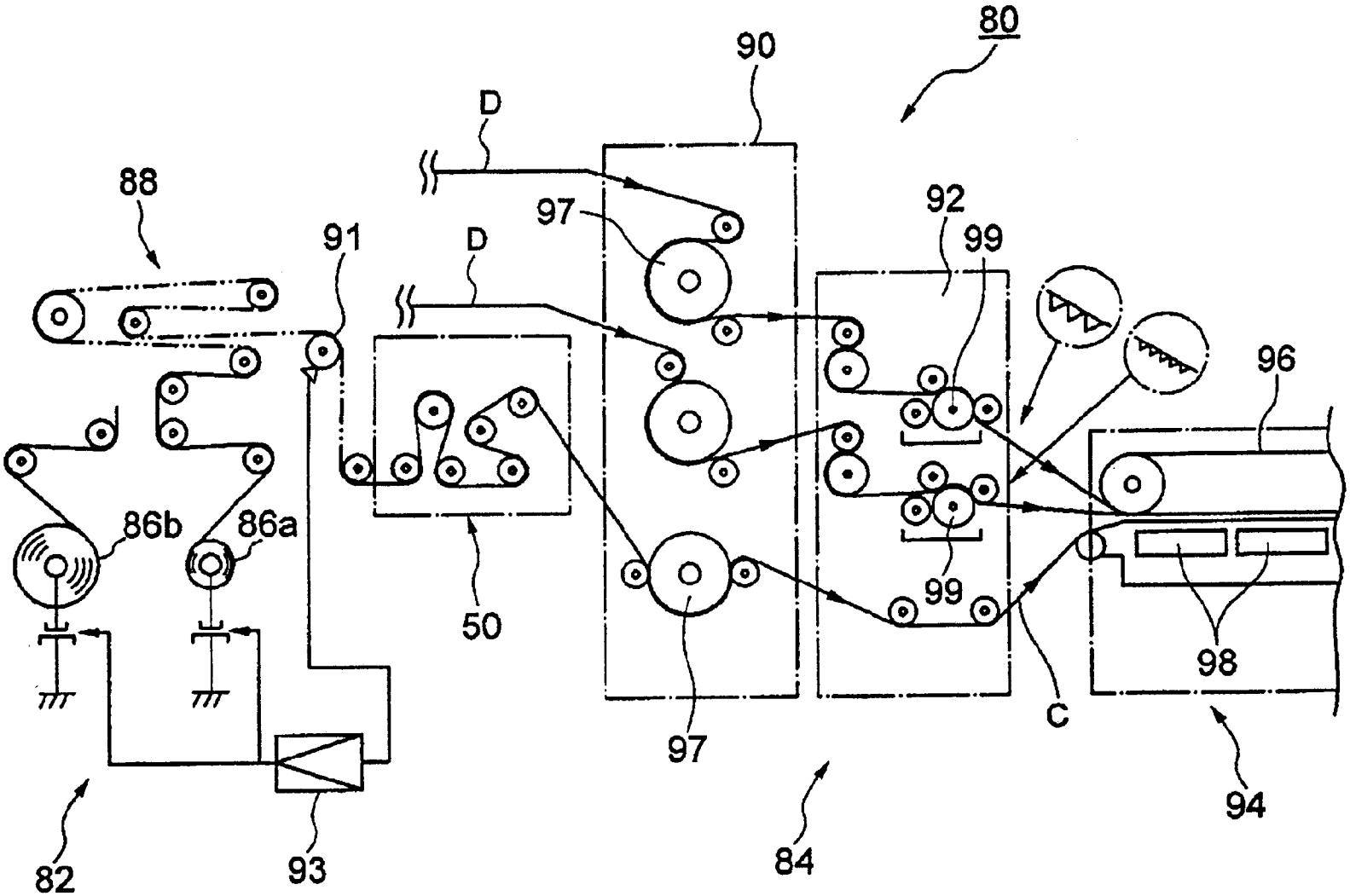
FIG. 6 is an overall schematic system diagram of a double-faced cardboard sheet manufacturing apparatus according to the second embodiment of the present invention.
Figure 7:
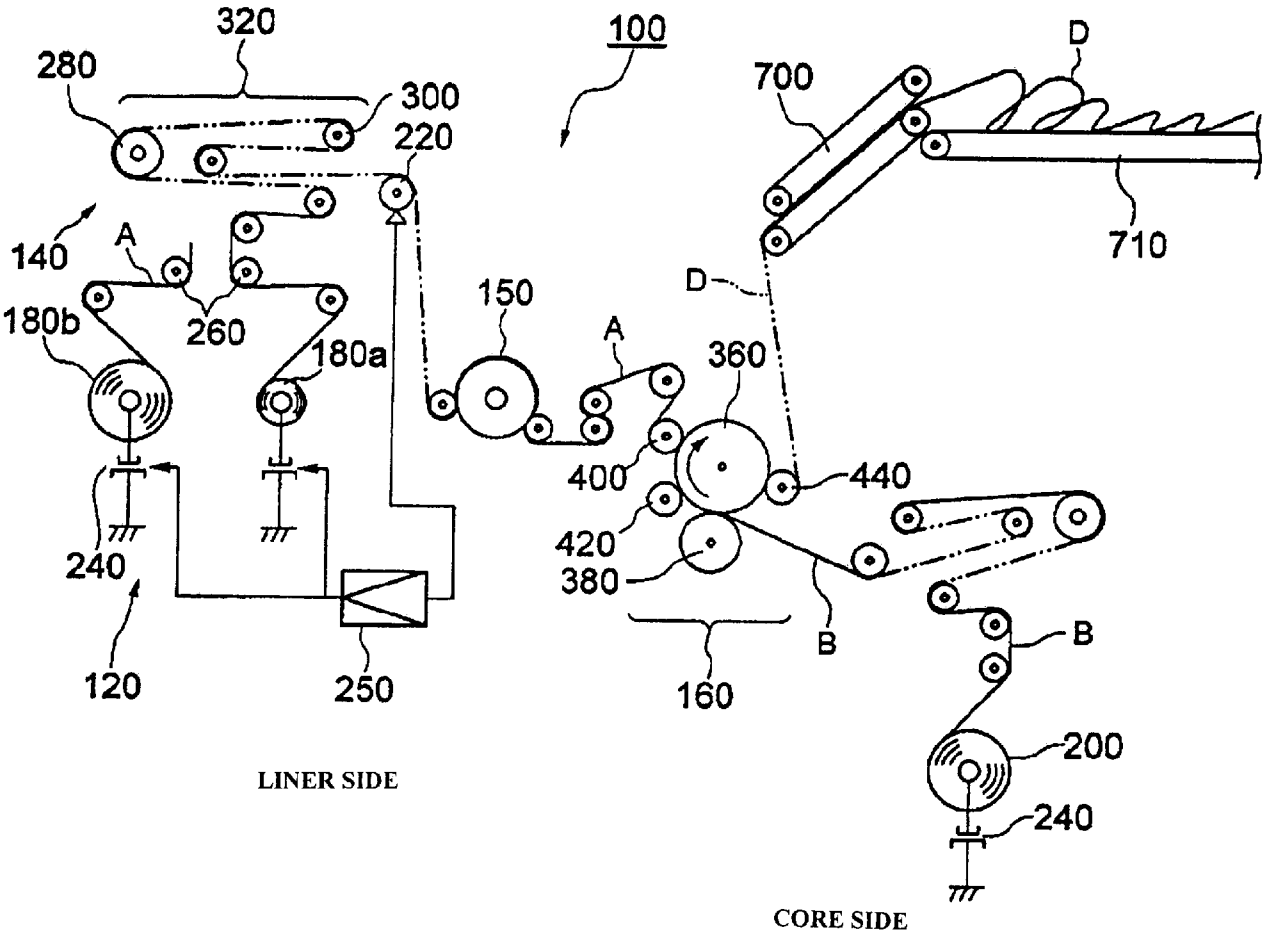
FIG. 7 PRIOR ART
FIG. 7 is an overall schematic system diagram of a conventional single-faced cardboard sheet manufacturing apparatus.

The second embodiment of the present invention will be described with reference to FIG. 6. FIG. 6 is an overall schematic system diagram of a double-faced cardboard sheet manufacturing apparatus constituting the second embodiment of the present invention.

The cardboard sheet manufacturing apparatus of the second embodiment is a double-faced cardboard sheet manufacturing apparatus. It is used to manufacture a double-faced cardboard sheet which is formed by gluing together two layers of single-faced cardboard sheets D, that has different fluting, and a back liner C.

As shown in FIG. 6, the double-faced cardboard sheet manufacturing apparatus 10 is substantially constructed from a first apparatus (not shown) which manufactures a single-faced cardboard sheet D used for A fluting, a second apparatus (not shown) which manufactures a single-faced cardboard sheet D used for B fluting, a back liner supply device 82 which supplies the back liner C, and a double-facer 84 which manufactures a double-faced cardboard sheet by gluing together the single-faced cardboard sheets D and the back liner C.

The roll stand 86 is provided with liner driven rolls 86*a* and 86*b* and a tension detection assembly 91. Each of the liner driven rolls 86*a* and 86*b* is wound with the back liner C. The tension detection assembly 91 is installed between the liner driven rolls 86*a* and 86*b* and a pre-heater 90 so as to detect the tension generated in the back liner C. The liner driven rolls 86*a* and 86*b* are provided with tension rough adjusting devices. The tension rough adjusting devices adjust the rotational speed of the liner driven rolls 86*a* and 86*b* based upon the tension detected by the tension detection assembly 91, thus roughly adjusting the tension generated in the back liner C.

The pre-heater 90 is provided therein with a drum 97 that is heated so as to preheat the single-faced cardboard sheets D and the back liner C.

The first and second apparatuses for manufacturing the single-faced cardboard sheets D used for A and B fluting are the same as the apparatus of the first embodiment. The description of these apparatus is thus omitted here. The apparatuses used to manufacture the single-faced cardboard sheets D used for A and B fluting are respectively equipped with tension fluctuation absorbing devices in the vicinity of their respective double-facers on the upstream side of the double facers.

As in the case of the liner supply in the first embodiment, the back liner supply device 82 has a back liner roll stand 86 and a splicer 88. Furthermore, a tension fluctuation absorbing device 50 is installed in the vicinity of the double-facer that will be described below, on the upstream side of the double-facer. The tension fluctuation absorbing device 50 comprises a tension fluctuation detection means and a tension adjustment means. The tension fluctuation absorbing device 50 is the same as the tension fluctuation absorbing device of the first embodiment. Accordingly, a description of this device will be omitted here.

The double-facer 84 is comprised of the pre-heater 90, a glue machine 92 and a heating unit 94. The pre-heater 90 is used for pre-heating the supplied single-faced cardboard sheets D that are manufactured in parallel by the respective apparatuses for the manufacture of single-faced cardboard sheets D and also for pre-heating the supplied back liner C. The glue machine 92 is used for applying glue to the pre-heated single-faced cardboard sheets D and back liner C. The heating unit 94 is used for bonding the glue-coated single-faced cardboard sheets D and back liner C.

The operation of the above double-faced cardboard sheet manufacturing apparatus will be described below.

First, the single-faced cardboard sheets D used for the A fluting and B fluting are manufactured in parallel by respective single-faced cardboard sheet manufacturing apparatuses. These sheets are supplied to the pre-heater 90 and pre-heated. At the same time, the back liner C is likewise supplied to the pre-heater 90 by the back liner supply device 82 and is pre-heated by the pre-heater 90. In this case, the respective single-faced cardboard sheets D are processed by the tension fluctuation absorbing devices installed in the vicinity of the respective single-facers on the upstream side of the single-facers in the same manner as in the first embodiment. In particular, fluctuations in the tension generated in the liner or core in the paper-splicing mode or ordinary operating mode are detected by the tension fluctuation detection means, and these tension values are adjusted by the tension adjustment means on the basis of the detected fluctuations in the tension. Thus, single-faced cardboard sheets D in which good bonding between the liner and core is ensured are supplied. Similarly, in regard to the back liner C as well, fluctuations in the tension applied to the back liner C in the paper-splicing mode or ordinary operating mode are prevented by the respective tension fluctuation absorbing device installed in the vicinity of the pre-heater 90 on the upstream side of the pre-heater 90 and on the downstream side of the splicer 88.

The single-faced cardboard sheets D (used for the A fluting and B fluting) and the back liner C in which pre-heating has been completed are respectively conveyed into the glue machine 92. In the glue machine 92, glue is applied to the respective sheets by the same method as in the single-facer described in the first embodiment.

The glue machine 92 is provided therein with a glue roll 99 that apply glue to the core corrugation peaks of the single-faced cardboard sheets D that is used for the A fluting and B fluting.

Next, the single-faced cardboard sheets D (used for the A fluting and B fluting) and the back liner C in which glue application has been completed are respectively conveyed to the heating unit 94. In the heating unit 94, the sheets are conveyed by the conveyor 96 in a state in which the liner outer surface of the B-fluting single-faced cardboard sheet D is superimposed on the core corrugation peaks of the A-fluting single-faced cardboard sheet D, and the back liner C is superimposed on the core corrugation peaks of the B-fluting single-faced cardboard sheet D; and the sheets are heated by a heating box 98. During this conveyance, bonding is completed, and a double-faced cardboard sheet is completed.

In the completed double-faced cardboard sheet, not only is the bonding of the single-faced cardboard sheets D used for the A fluting and B fluting good, but the occurrence of warping in the double-faced cardboard sheet as a whole is also effectively prevented. Furthermore, the overall product yield can be maintained when the double-faced cardboard sheet is cut or the amount of production is measured in after-processes, since the spacing between marks printed on the sheet can be maintained at a substantially constant value.

Embodiments of the present invention are described in detail above. However, various alterations and modifications are possible within the scope of the inventions described in the claims.

For example, in the first embodiment, a tension fluctuation absorbing device is installed on the liner side for a single-facer of a type in which the liner and core are bonded exclusively by means of tension applied to the liner. However, the present invention is not limited to this arrangement. It is possible to apply the present invention to a single-facer of the conventional type in which bonding is accomplished by means of a nip pressure. In such a case, it is preferable to install the tension fluctuation absorbing device on the core side. By way of this arrangement, the application of an excessive tension to the core can be avoided by preventing fluctuations in tension in the paper-splicing mode or ordinary operating mode. As a result, breaking or collapse of the corrugations of the core can be effectively prevented.

Furthermore, in the second embodiment, the tension fluctuation absorbing device is installed not only in the vicinity of the double-facer on the upstream side of the double-facer in order to handle the back liner C, but also in the vicinity of the single-facers on the upstream side of the single-facers in order to handle the single-faced cardboard sheets D that are glued to the back liner C. However, the present invention is not limited to this arrangement. The tension fluctuation absorbing device can be installed only on the back liner C side, or it can be installed only on the side of one of the single-faced cardboard sheets D used for A fluting and B fluting.

As described above in detail, the cardboard sheet manufacturing apparatus of the present invention effectively handle fluctuations in the tension generated in the material paper quickly and reliably.

Furthermore, a high-quality cardboard sheet can be manufactured by reliably achieving good bonding between the core material paper and liner material paper.

Also, the tension fluctuation absorbing device of the present invention prevents fluctuations in the tension generated in the material paper, especially in the liner. Furthermore, the tension fluctuation absorbing device of the present invention can be incorporated into existing cardboard manufacturing apparatuses as a self-contained unit without any need for extensive modifications or alterations.

What is claimed is:

1. A single-faced cardboard sheet manufacturing apparatus equipped with a single-facer that manufactures a single-faced cardboard sheet by gluing together a liner material paper and a core material paper in a specified corrugated form, while feeding out said liner material paper and core material paper, said single-faced cardboard sheet manufacturing apparatus further comprising a tension fluctuation detection means and a tension adjustment means, wherein said tension fluctuation detection means is provided in the vicinity of said single-facer on an upstream side of said single-facer and is used to detect fluctuations in tension generated in said liner material paper and/or core material paper, said tension fluctuation detection means comprising:

a dancer roll on which said liner material paper and/or core material paper are wound, a pinion/rack mechanism which supports said dancer roll so that said dancer roll can roll in a direction that is substantially perpendicular to an axial line of said dancer roll, said pinion/rack mechanism comprising pinions that are installed on respective ends of said dancer roll and racks that engage with said pinions, a piston/cylinder mechanism which drives said dancer roll so as to balance a tension that acts on said dancer roll via said liner material paper and/or core material paper on an upstream side of said dancer roll and via said liner material paper and/or core material paper on a downstream side of said dancer roll, and guide rolls which are respectively installed on said upstream side and on said downstream side of said dancer roll so that a direction of extension of said liner material paper and/or core material paper on said upstream side of said dancer roll and a direction of extension of said liner material paper and/or core material paper on said downstream side of said dancer roll are both substantially parallel to a direction of extension of said racks; and said tension adjustment means is provided in the vicinity of said tension fluctuation detection means on an upstream side of said tension fluctuation detection means and is used to adjust said tension generated in said liner material paper and/or core material paper in the vicinity of said single-facer by increasing or reducing a feed-out speed of said liner material paper and/or core material paper to said single-facet based upon fluctuations in tension detected by said tension fluctuation detection means, said tension adjustment means comprising:

a driving roll which feeds out said liner material paper and/or core material paper, a rotational speed adjustment means which is used to adjust a rotational speed of said driving roll, and pressing rolls which are installed adjacent to said driving roll, said pressing rolls comprising a plurality of rolls which have axial lengths that are shorter than an axial length of said driving roll and which are arranged substantially in a straight line along said axial length of said driving roll, so that said tension adjustment means applies a specified nip pressure to said liner material paper and/or core material paper that pass between said driving roll and said pressing rolls whereby generation of wrinkles in the liner paper material can be prevented.

2. The single-faced cardboard sheet manufacturing apparatus according to claim 1, wherein said guide rolls set a winding angle of said material paper on said dancer roll of substantially 180 degrees.

3. A double-faced cardboard sheet manufacturing apparatus equipped with a double-facer that manufactures a double-faced cardboard sheet by gluing together a single-faced cardboard sheet and a back liner, said single-faced cardboard sheet comprising a liner and a core that is formed into a specified corrugated form, wherein said double-faced cardboard sheet manufacturing apparatus comprises a tension fluctuation detection means and a tension adjustment means, and wherein:

said tension fluctuation detection means provided in the vicinity of said double-facer and on an upstream side of said double-facer and used to detect fluctuations in tension generated in said back liner and, said tension fluctuation detection means comprising:

a dancer roll on which said back liner is wound, a pinion/rack mechanism which supports said dancer roll so that said dancer roll can roll in a direction that is substantially perpendicular to an axial line of said dancer roll, said pinion/rack mechanism comprising pinions that are installed on respective ends of said dancer roll and racks that engage with said pinions, a piston/cylinder mechanism which drives said dancer roll so as to balance a tension that acts on said dancer roll via said back liner on an upstream side of said dancer roll and via said back liner on a downstream side of said dancer roll, and guide rolls which are respectively installed on said upstream side and on said downstream side of said dancer roll so that a direction of extension of said back liner on said upstream side of said dancer roll and a direction of extension of said back liner on said downstream side of said dancer roll are both substantially parallel to the direction of extension of said racks; and said tension adjustment means is provided in the vicinity of said tension fluctuation detection means on an upstream side of said tension fluctuation detection means and is used to adjust said tension generated in said back liner in the vicinity of said double-facer by increasing or reducing a feed-out speed of said back liner to said double-facer based upon fluctuations in tension detected by said tension fluctuation detection means, said tension adjustment means comprising:

a driving roll which feeds out said back liner, a rotational speed adjustment means which is used to adjust a rotational speed of said driving roll, and pressing rolls which are installed adjacent to said driving roll, said pressing rolls comprising a plurality of rolls which have axial lengths that are shorter than an axial length of said driving roll and which axe arranged substantially in a straight line along said axial length of said driving roll, so that said tension adjustment means applies a specified nip pressure to said back liner that pass between said driving roll and said pressing rolls whereby generation of wrinkles in the liner paper material can be prevented.

4. The double-faced cardboard sheet manufacturing apparatus according to claim 3, wherein said guide rolls set a winding angle of said material paper on said dancer roll of substantially 180 degrees.

* * * * *